US008292281B1

(12) United States Patent
Smith

(10) Patent No.: US 8,292,281 B1
(45) Date of Patent: Oct. 23, 2012

(54) STAKE INSTALLATION TOOL

(76) Inventor: Michael C. Smith, Fairview, TN (US)

( * ) Notice: Subject to any disclaimer, the term of this patent is extended or adjusted under 35 U.S.C. 154(b) by 434 days.

(21) Appl. No.: 12/561,588

(22) Filed: Sep. 17, 2009

(51) Int. Cl.
*B25B 11/02* (2006.01)

(52) U.S. Cl. ..... 269/287; 269/270; 269/278

(58) Field of Classification Search ..... 269/287, 269/270, 278, 275, 268, 255
See application file for complete search history.

(56) References Cited

U.S. PATENT DOCUMENTS

| | | | | |
|---|---|---|---|---|
| 3,034,025 | A | 5/1962 | Budreck et al. | |
| 3,735,819 | A | 5/1973 | Ramsey | |
| 3,910,556 | A | 10/1975 | Tiede | |
| 4,101,088 | A | 7/1978 | Stauth | |
| 4,263,972 | A | 4/1981 | Johnson | |
| 4,291,495 | A | 9/1981 | Crippen | |
| 4,633,563 | A | 1/1987 | Rykaczewski | |
| 4,706,864 | A | 11/1987 | Jacobsen et al. | |
| 4,813,494 | A | 3/1989 | Beard et al. | |
| 4,976,483 | A | 12/1990 | Cunningham | |
| 5,163,597 | A | 11/1992 | Napoli, Jr. et al. | |
| 5,253,958 | A | 10/1993 | Bellemare | |
| 5,667,021 | A | 9/1997 | Bailey et al. | |
| 5,875,534 | A * | 3/1999 | Jackson | 29/255 |
| 6,347,672 | B1 | 2/2002 | Reardon | |
| 6,585,456 | B2 | 7/2003 | Forse | |
| 6,663,324 | B2 | 12/2003 | Nordloh | |
| 6,772,565 | B1 | 8/2004 | Schiltz et al. | |
| 6,832,575 | B2 | 12/2004 | Carroll, Jr. | |
| 6,932,164 | B1 | 8/2005 | Williston | |
| 7,351,016 | B1 | 4/2008 | Nordloh | |
| 7,496,999 | B2 * | 3/2009 | Robarge | 29/265 |
| 2004/0202512 | A1 | 10/2004 | Smith | |
| 2006/0225342 | A1 | 10/2006 | Hamman | |
| 2009/0194575 | A1 | 8/2009 | Hamman | |
| 2011/0209657 | A1 * | 9/2011 | Carrette | 116/209 |

* cited by examiner

*Primary Examiner* — Lee D Wilson
(74) *Attorney, Agent, or Firm* — Stephen T. Belsheim

(57) ABSTRACT

A stake installation tool for installing a stake in strata wherein the stake has a head at one end and a strata penetrator at the other end. The stake installation tool includes a driver. The stake installation tool further includes a stake retention assembly including a retention body, which contains a retention passageway. There is a flexible holder connected to the retention body. The head of the stake is received within the retention passageway and the flexible holder engages the head of the stake to operatively retain the stake.

12 Claims, 9 Drawing Sheets

STAKE INSTALLATION TOOL

BACKGROUND OF THE INVENTION

The present invention pertains to a tool useful to install stakes or other kinds of fasteners into a substrate so as to retain another member to the substrate. More specifically, the invention pertains to a tool useful to install a stake (or other fastener) into a substrate (such as, for example, earth strata) to retain another member such as, for example, a piece of sod, an erosion control blanket, a seed blanket or the like to the earth strata.

In many excavation situations, such in highway construction, the earth strata is disturbed and left exposed to the elements. In order to avoid or reduce erosion damage (e.g., soil erosion) to the earth strata (i.e., the ground), it is beneficial to provide promptly a layer of vegetation on the exposed earth strata. Sod, erosion control blankets or seed blankets have been ways to overlay the exposed earth strata to provide such a layer of vegetation.

Sod, erosion control blankets or seed blankets may come in a roll or strip or section. Since it is important to provide close physical contact between the earth strata and the sod, erosion control blanket or seed blanket, oftentimes the worker affixes the sod or erosion control blanket to the ground or earth strata using stakes or anchors. These stakes can metallic or non-metallic. In the case of a non-metallic stake, the stake can be of plastic or biodegradable material.

In a simplistic fashion, the worker has used a hammer to actually drive or pound the stake (provided the stake has a suitable geometry) through the sod, erosion control blanket or seed blanket and into the earth strata. While using a hammer has been effective to affix the sod, erosion control blanket or seed blanket to the earth strata, the continuous bending and hammering of the stakes can be wearisome to the worker. As an alternative to the use of a hammer, some have developed complex machinery to secure an erosion control blanket to the earth strata. U.S. Pat. No. 6,663,324 B2 to Nordloh and U.S. Pat. No. 7,351,016 B1 to Nordloh are patents that show exemplary complex machinery. Still another has used a magnetic head at the distal end of a handle such as shown in U.S. Published Patent Application No. US2006/0225342 A1 for an ANCHORING PIN INSERTION UNIT to Hamman. However, the device of Hamman appears to be only suitable to work with stakes that are magnetic, and hence, attachable to the magnetic head.

Thus, it becomes apparent that it would be desirable to provide a stake installation tool that is an improvement over the use of a hammer to install stakes into the earth strata, and yet, is not a complex machine. More specifically, it would be desirable to provide a stake installation tool that does not require the worker to bend over repeatedly to install the stake into the earth strata. It would be desirable to provide a stake installation tool that permits the worker to easily position the stake with reference to the tool prior to installation. It would be desirable to provide a stake installation tool that is simple to use. It would be desirable to provide a stake installation tool that can accommodate a variety of different kinds of stakes including metallic stakes (both magnetizable and non-magnetizable metallic stakes) and non-metallic stakes including without limitation plastic or biodegradable stakes. It would be desirable to provide a stake installation tool that the worker can repair easily in the field. It would be desirable to accomplish the above objectives without the need to use a complex piece of machinery.

SUMMARY OF THE INVENTION

In one form, the invention is a stake installation tool for installing a stake in strata wherein the stake has a head (with a bottom surface) at one end and a strata penetrator at the other end. The stake installation tool includes a driver. The stake installation tool further includes a stake retention assembly including a retention body, which contains a retention passageway. There is a flexible holder connected to the retention body. The head of the stake is received within the retention passageway and the flexible holder engages the head of the stake to operatively retain the stake.

In another form thereof, the invention is a method of installing in a strata a stake that has a head at one end thereof and a strata penetrator at the other end thereof. The method comprises the steps of: providing a stake installation tool comprising a driver and a stake retention assembly including a retention body containing a retention passageway, and a flexible holder connected to the retention body; inserting the head of the stake into the retention passageway whereby the flexible holder engages the head of the stake to operatively retain the stake; and driving the stake installation tool into the strata whereby the stake penetrates the strata.

In yet another form, the invention is a stake installation tool for installing a stake in strata wherein the stake has a head at one end and a strata penetrator at the other end. The stake installation tool comprises a driver and a stake retention assembly including a retention body, which contains a retention passageway. The stake installation tool further includes a flexible holder connected to the retention body wherein the flexible holder comprising a plurality of brushes. When the head of the stake is received within the retention passageway, the brushes engage the head of the stake. The brushes have a stiffness level between a minimum stiffness level stiff enough to operatively retain the stake within the retention passageway when the stake is within the retention passageway and a maximum stiffness level flexible enough to allow the stake installation tool to move away from the stake after installation of the stake in the strata without lifting the stake out of the strata.

BRIEF DESCRIPTION OF THE DRAWINGS

The following is a brief description of the drawings that form a part of this patent application:

FIG. 7 is a isometric view of another embodiment of the stake retention assembly with the top surface containing an integral neck wherein the neck contains a threaded bore wherein the treaded bore receives the threaded portion of a handle or the like;

DETAILED DESCRIPTION OF EMBODIMENTS

Figure 1:
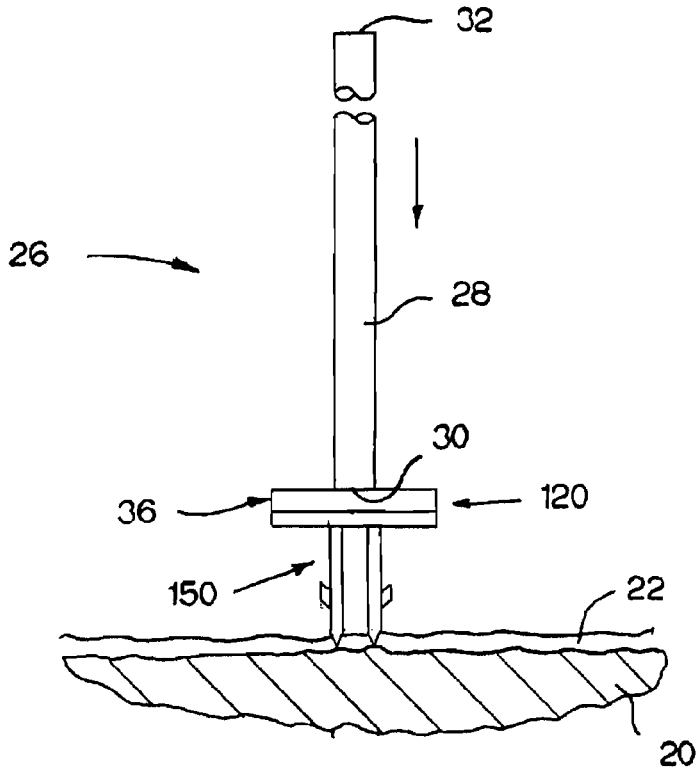
FIG. 1 is a side mechanical schematic view of an embodiment of the stake installation tool with a stake retained thereto, and in a condition prior to the installation of the stake in the strata.

Referring to the drawings, there is illustrated in FIG. 1 a specific embodiment of the stake installation tool generally designated as 26. The stake installation tool 26 is useful to install a stake (150) into a strata 20, e.g., earth strata. There should be an appreciation that the stake 150 can be of a wide variety of materials. The stake can be metallic, which includes magnetizable metallic materials and non-magnetizable metallic materials. The stake can be non-magnetic, which includes plastic or biodegradable materials. The stake can also present such a geometry and composition to be suitable for different soil conditions found in different geological and geographic regions.

One typical environment to install stakes (150) is in connection with the installation of a sod, erosion control blanket or seed blanket (22) over the ground or earth strata 20. One typical environment is in an excavation situations, such in highway construction, wherein the earth strata is disturbed and left exposed to the elements. The stake 150 passes through the sod, erosion control blanket or seed blanket 22 and enters into the earth strata 20 thereby securing the sod, erosion control blanket or seed blanket 22 to the earth strata 20. Although only one stake 150 is shown, the typical application uses many stakes sometimes into the hundreds or even into the thousands.

The stake installation tool 26 includes an elongate driver (or handle) 28, which has a proximate end 30 and a distal end 32. The stake installation 26 further includes a stake retention assembly 36, which is connected or attached to the driver 28 at the proximate end 30 thereof. Here, the driver 28 is shown broken. As one could appreciate, the length and dimension of the driver 28 can be of any suitable magnitude to accommodate the worker. Along this line, the driver 28 has an axial length between the proximate end 30 and the distal end 32. The axial length is adjustable to accommodate workers of different statures (e.g., heights).

The stake retention assembly 36 comprises a retention body 42, which has a top surface 44 and a bottom surface 46. The stake retention body 42 can be of a wear-resistant material such as, for example, acetal. A screw 48, with a distal end 50, projects from the top surface 44. In the case of a wooden driver 28, the screw 48 extends into the driver 28 to secure the stake retention assembly 36 to the driver.

Figure 7:
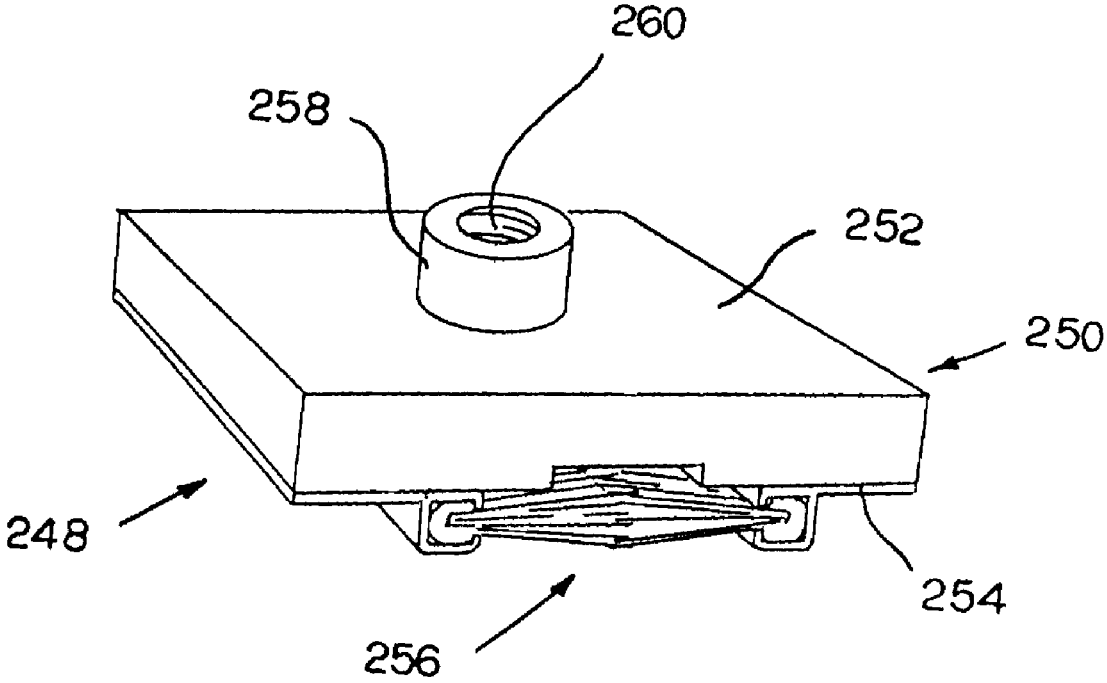

In reference to the connection of the stake retention assembly 36 to the driver, as illustrated in FIG. 7, another embodiment of the stake retention assembly generally designated as 248 has a stake retention body 250. Stake retention body 250 has a top surface 252 and a bottom surface 254 wherein a brush assembly 256 attaches to the bottom surface 254. An integral neck 258 projects away from the top surface 252. The integral neck 258 contains a threaded bore 260, which is adapted to receive the threaded end of a handle or driver.

Figure 6:
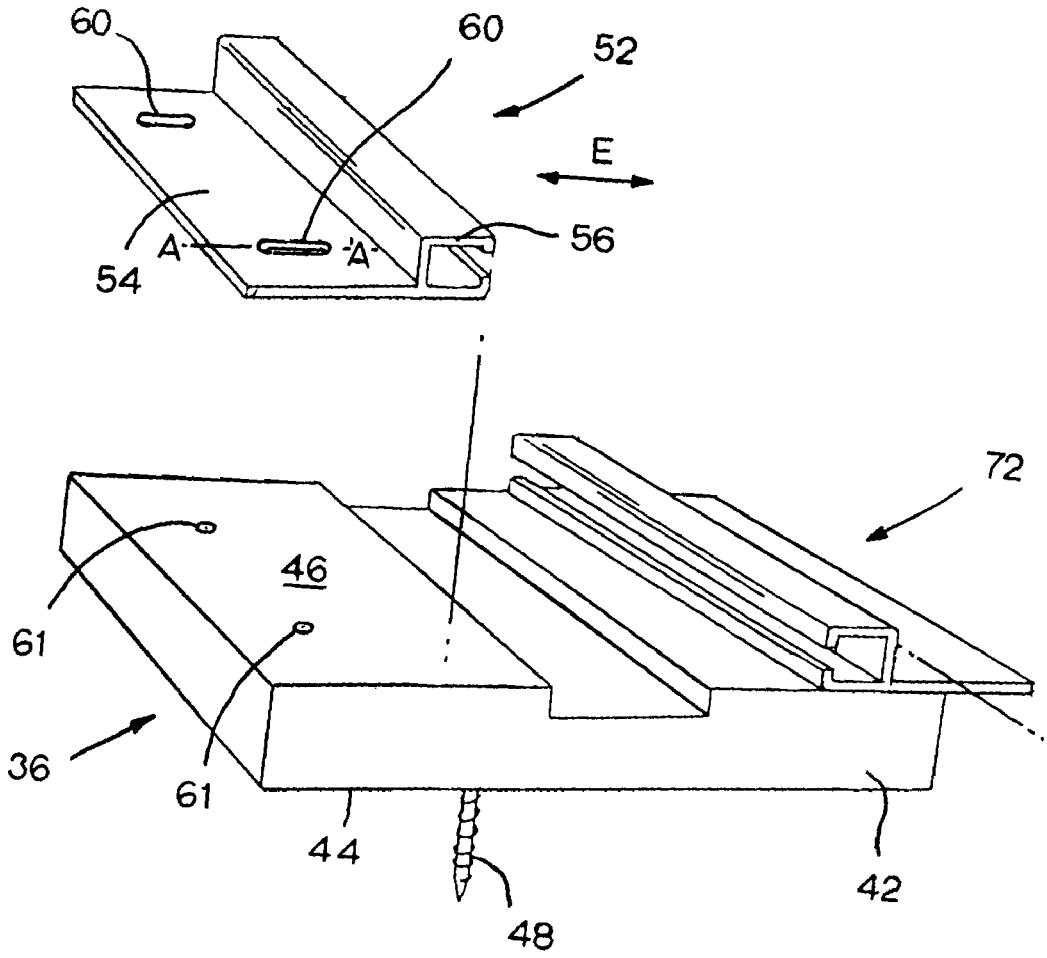
FIG. 6 is an isometric view of a stake retention assembly with a bracket exploded away showing the bores in the retention body wherein the bores align with their respective slots in the corresponding bracket and wherein screws pass through the slots and into the bores to attach the bracket to the retention body.

The stake retention assembly 36 further includes one bracket 52. The one bracket 52 has a flange 54 and a retention bracket 56 with a retention bracket slot 58. As shown in FIG. 6, the flange 54 of the bracket 52 contains a pair of spaced apart slots 60, which have a longitudinal axis A-A. The actual dimensions d magnitude of the slots 60 could vary depending upon the extent one desires to adjust the bracket. When the bracket 52 is affixed to the stake retention body 42, screws 63 pass through the slots 60 and into corresponding holes 61 in the stake retention body 42. The screws 63, when tightened affix the bracket 52 to the stake retention body 42. The ability of the bracket 52 to be adjustable and the advantages provided thereby will be discussed hereinafter.

Figure 5:
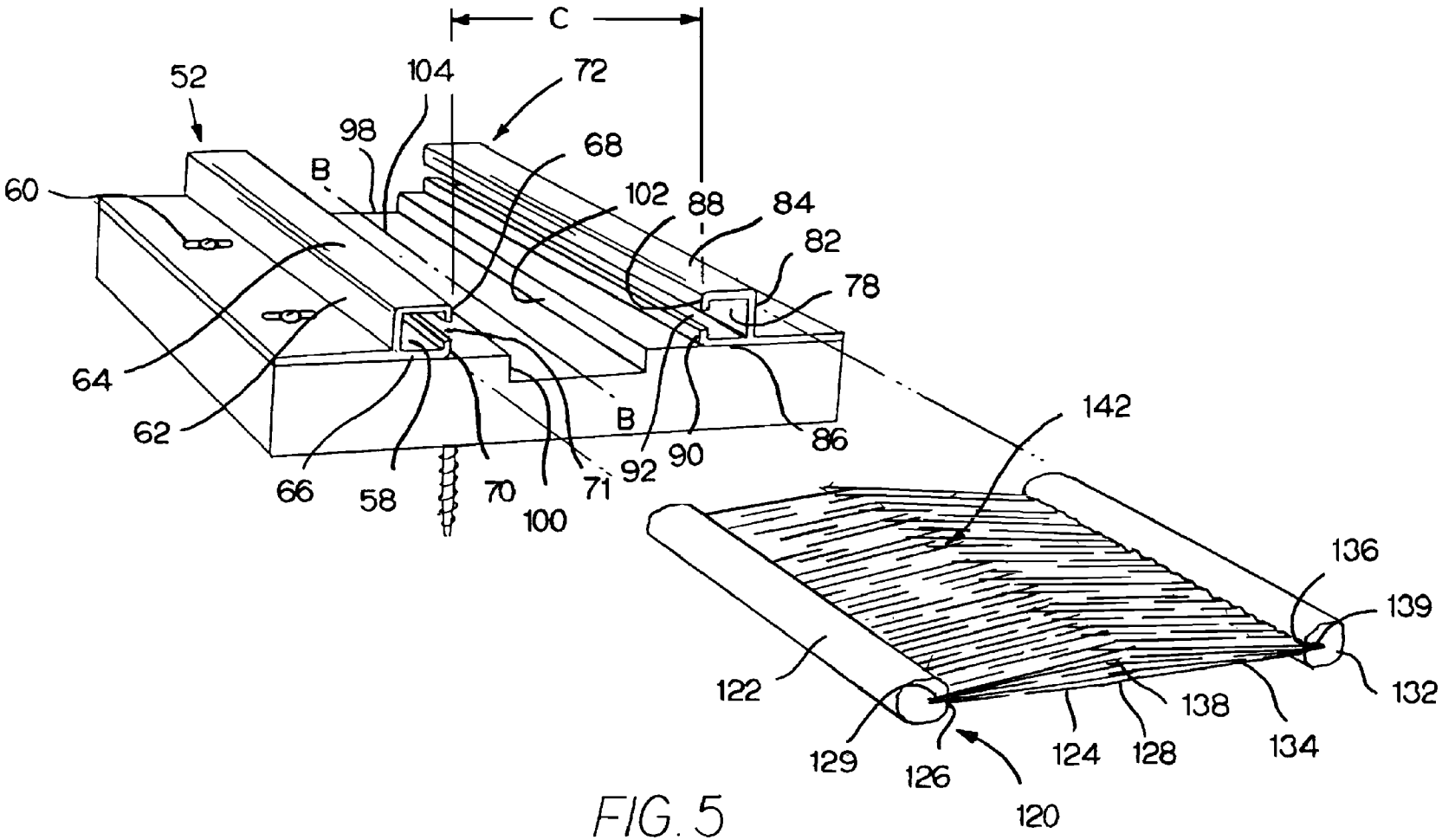
FIG. 5 is an isometric view of the stake retention assembly with the retention brush sets exploded away from the retention brackets and wherein the brackets are in one position relative to the retention passageway whereby the distal ends of the brushes overlap and essentially engage one another.

Referring to FIG. 5, the retention bracket slot 58 is defined by a side member 62 of the retention bracket 56, a bottom member 64 of the retention bracket 56, a top member 66 of the retention bracket 56, and a pair of projections 68 and 70 between which there is a gap 71. The stake retention assembly 36 further includes another bracket 72. The other bracket 72 has a flange 74 and a retention bracket 76 with a retention bracket slot 78. Although not illustrated in the same fashion, the other bracket 72 also has slots in the flange thereof that provide for an adjustability feature like of bracket 52. Referring to FIG. 5, the retention bracket slot 78 is defined by a side member 82 of the retention bracket 76, a bottom member 84 of the retention bracket 76, a top member 86 of the retention bracket 76, and a pair of projections 88 and 90 between which there is a gap 92.

The retention body 42 of the stake retention assembly 36 contains a retention passageway 98. The retention passageway 98 is open at opposite ends and further includes one (or a first) side surface 100, another (or a second) side surface 102, wherein the side surfaces (100, 102) join to a bottom surface 104. The retention passageway 98 has a central longitudinal axis B-B (see FIG. 5).

Figure 2:
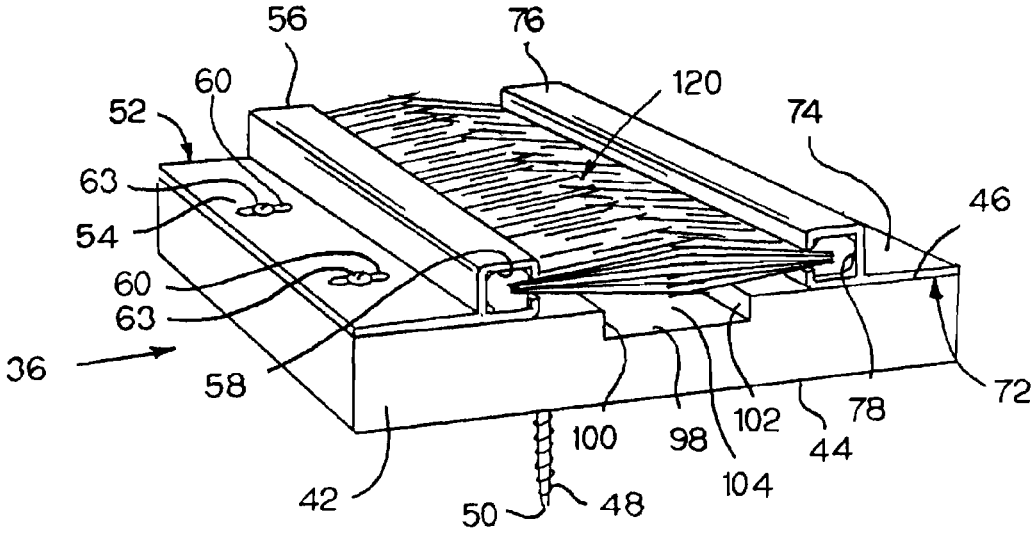
FIG. 2 is an isometric view of the stake retention assembly, which is a part of the stake installation tool of FIG. 1.

The stake retention assembly 36 further includes a brush assembly 120 (see, e.g., FIGS. 2 and 5) or flexible holder. The brush assembly 120 comprises one brush holder 122 and a plurality of brushes 124. The brushes 124 have a proximate end 126 and a distal end 128. The brush holder 122 contains a notch 129, to which the plurality brushes 124 connects or attaches at their proximate ends 126. The brush assembly 120 further comprises another brush holder 132 and a plurality of brushes 134. The brushes 134 have a proximate end 136 and a distal end 138. The brush holder 132 contains a notch 139, to which the plurality brushes 134 connects or attaches at their proximate ends 136. As shown in FIG. 5, the distal ends 128, 138 of the brushes 124, 134, respectively, overlap and engage one another in the region pointed out by reference numeral 142.

As is apparent, the flexible holder comprises a first retention bracket adjacent to the first side of the retention passageway and a second retention bracket adjacent to the second side of the retention passageway. There is a first retention brush set attached to the first retention bracket and extending over at least a portion of the retention passageway. There is a second retention brush set attached to the second retention bracket and extending over at least a portion of the retention passageway.

The stake 150 comprises a head 152, which has a top surface 154, a side surface 156 and a bottom surface 160. A pair of prongs 162 project out of the bottom surface 160 wherein the prongs 162 are joined at their proximate ends 164 to the bottom surface 160 of the head 152. The prongs 162 each have a distal end 166, which defines a point (or strata penetrator) 168.

Figure 3A:
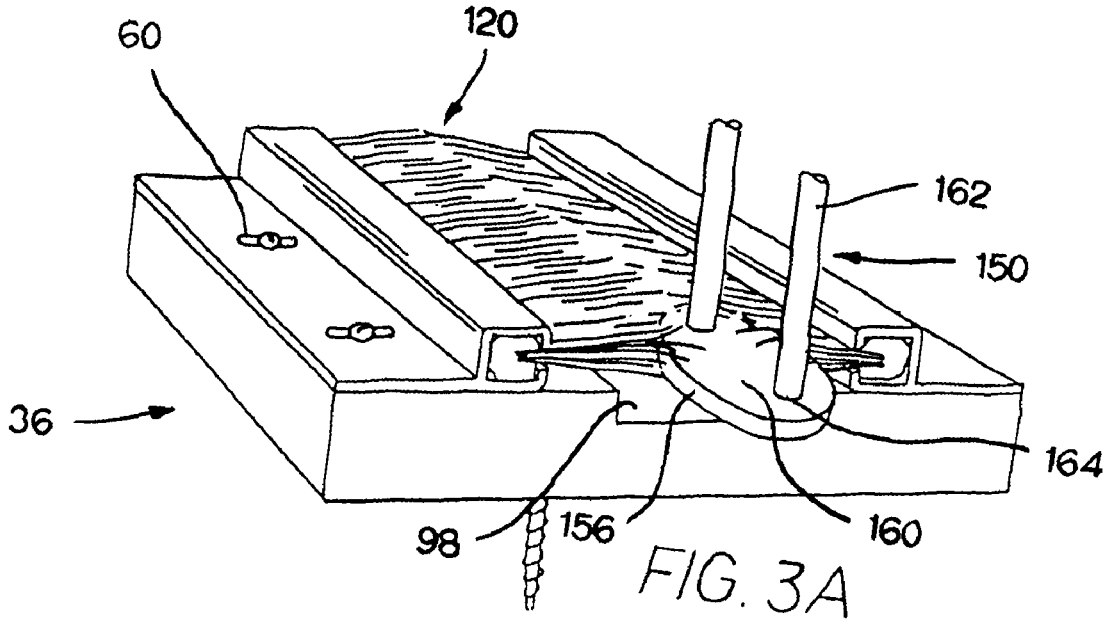
FIG. 3A is an isometric view of the stake retention assembly of FIG. 2, which is a part of the stake installation tool of FIG. 1, with the stake beginning to be inserted into the retention passageway.
Figure 3B:
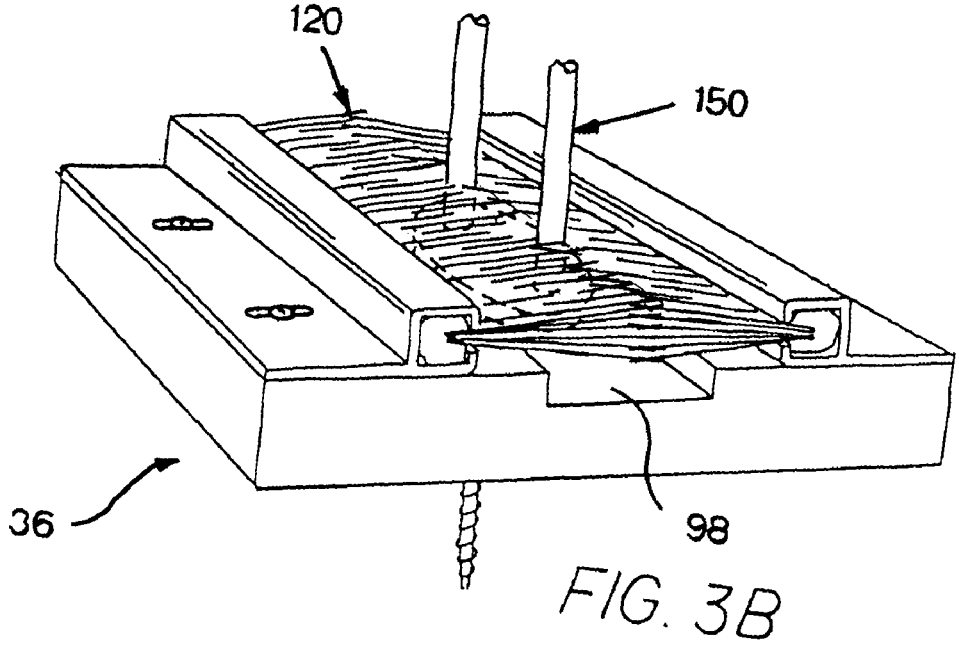
FIG. 3B is an isometric view of the stake retention assembly of FIG. 2, which is a part of the stake installation tool of FIG. 1, wherein the stake has been inserted into the retention passageway.
Figure 4A:
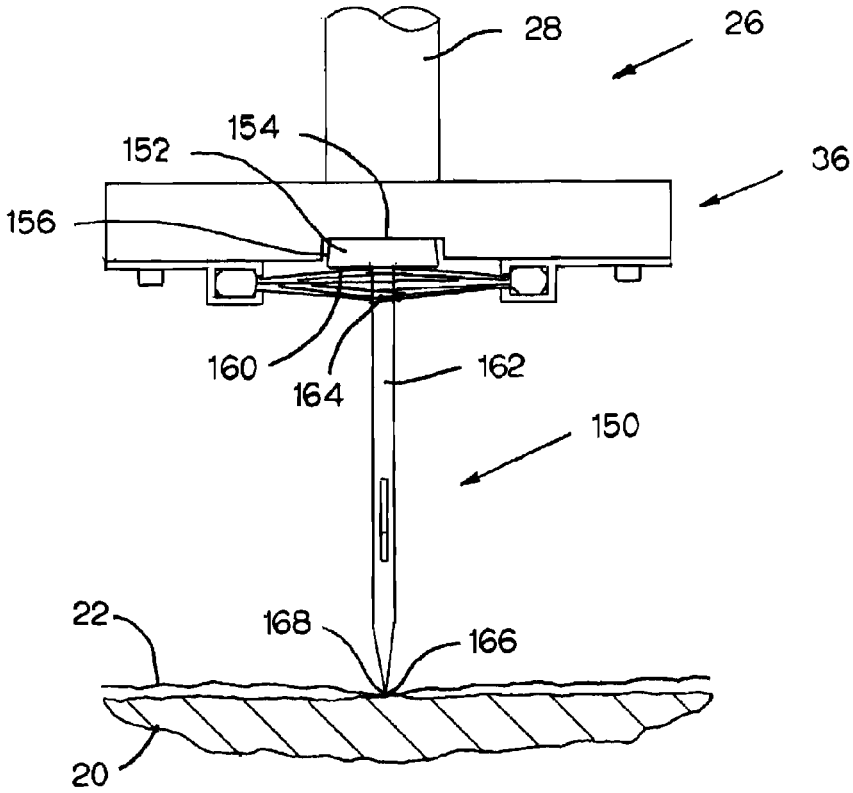
FIG. 4A is a side view of the lower end of the stake installation tool of FIG. 1 with a stake retained thereto, and in a condition prior to the installation of the stake in the strata.
Figure 4B:
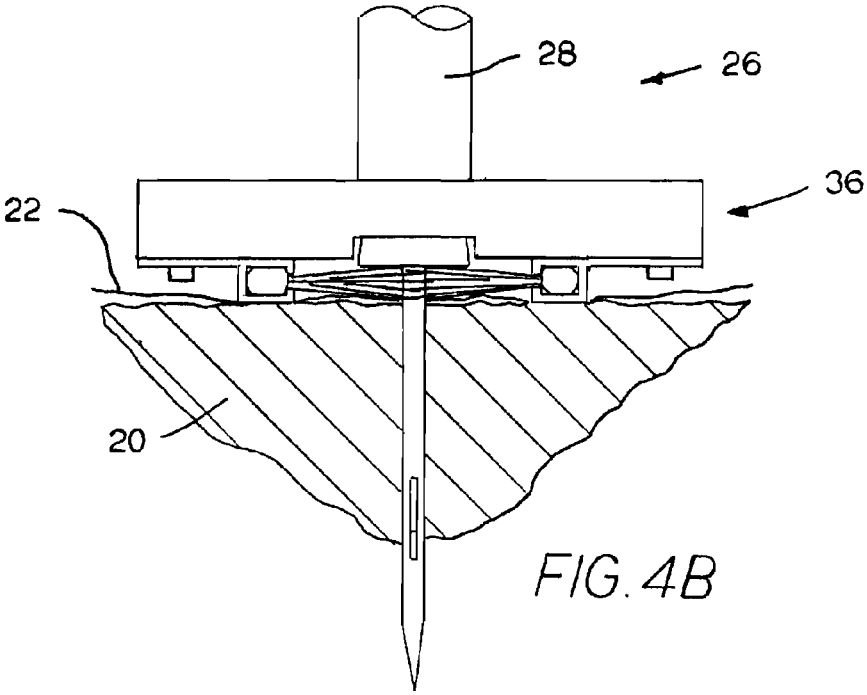
FIG. 4B is side view of the lower end of the stake installation tool of FIG. 1 with a stake retained thereto, and in a condition wherein the stake is installed into the strata.

In operation, the operator or worker inserts the head 152 of the stake 150 into the retention passageway 98 (see FIG. 3A) until the stake 150 is approximately midway between the opposite open ends of the retention passageway 98 (see FIG. 3B). It is apparent that the head 152 has a dimension such that it can enter and pass along the retention passageway 98. At this point, the flexible holder 120 engages the head 152 of the stake 150 to operatively retain the stake 150. More specifically, the brushes (124, 134) impinge and abut against the bottom surface 160 of the head 152 of the stake 150 to essentially restrain (or retain) the stake 150 from falling out of the retention passageway 98. This kind of restraint is a mechanical resistance. In other words, the stiffness of the brushes is such to retain the stake. What this means is that the brushes (124, 134) must be of a certain minimum level of stiffness to be able to retain the stake 150 within the retention passageway 98. Once the stake 150 has been positioned within the retention passageway 98 (see FIG. 4A), the worker presses or drives the stake installation tool 26 into the strata 20 whereby the stake 150 penetrates the strata 20. FIG. 4B shows the stake in the strata 20. Here, the head 152 is not fully driven into the strata 20. However, it is apparent that the strata could allow the stake installation tool to fully drive the stake into the strata.

Figure 4C:
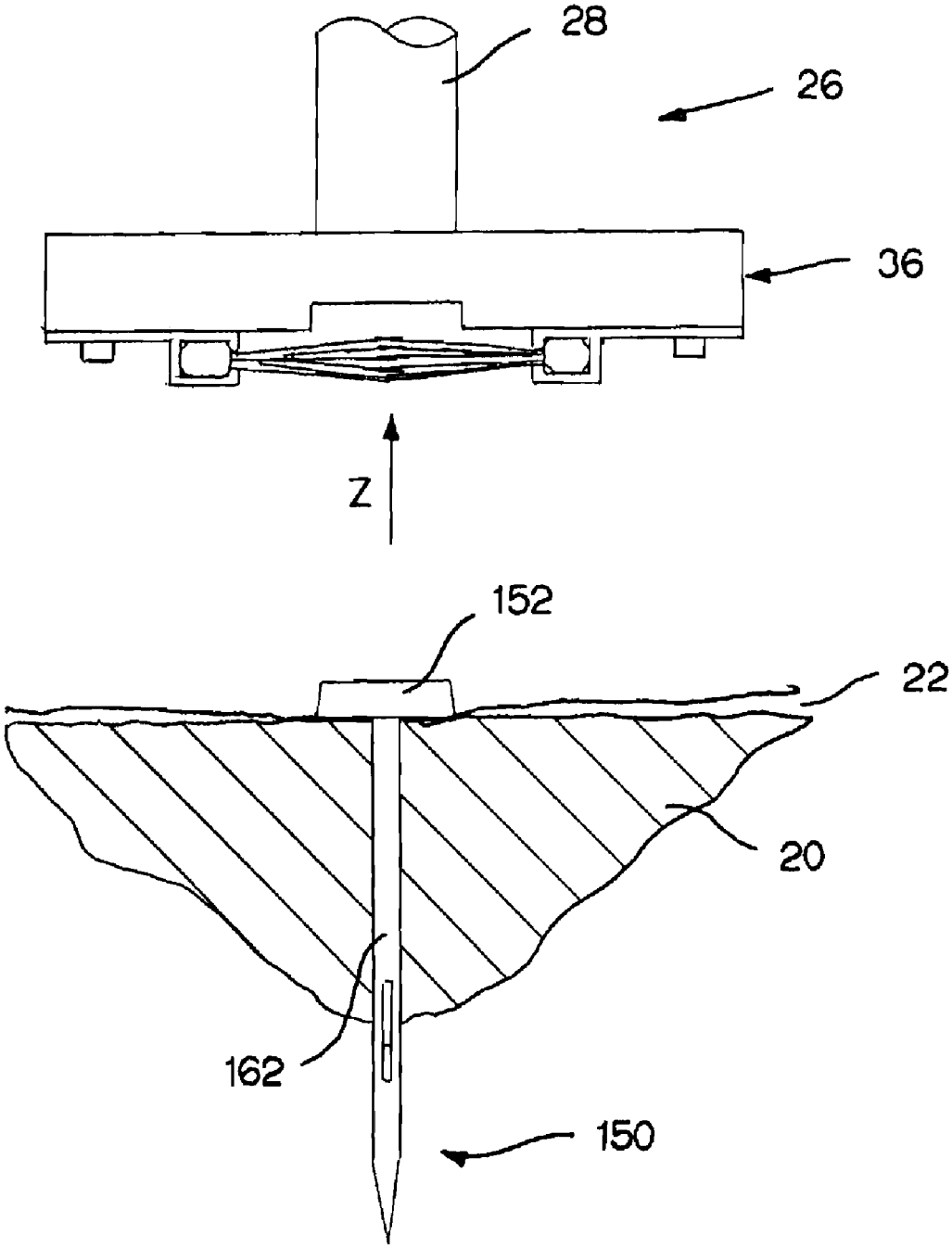
FIG. 4C is side view of the lower end of the stake installation tool of FIG. 1, and is in a condition wherein the stake installation tool has been withdrawn from the strata and the stake remains installed in the strata.

Once the stake 150 is secured into the strata 20, the worker then lifts up (see arrow "Z" in FIG. 4C) on the stake installation tool 26 thereby disengaging the stake installation tool 26 from the embedded stake 150. The brushes (124, 134) must not exceed a certain maximum level of stiffness so that when the stake installation tool 26 is lifted upward, the stake 150 stays in the strata 20 and is not pulled out of the strata 20. Thus, it is apparent that the brushes must exhibit a stiffness within a minimum stiffness level sufficient to retain the stake within the retention passageway and not greater than a maximum stiffness level so as to not pull the stake out of the strata when the stake installation tool is removed after installation of the stake. What this means is the brushes should have a stiffness level between a minimum stiffness level stiff enough to operatively retain the stake within the retention passageway when the stake is within the retention passageway and a maximum stiffness level flexible enough to allow the stake installation tool to move away from the stake after installation of the stake in the strata without lifting the stake out of the strata.

As mentioned hereinabove, via the slots 60, the brackets 52, 72 are adjustable in the direction E-E (see FIG. 6), which is transverse or perpendicular to the longitudinal axis (B-B) of the retention passageway. By being adjustable in the way they are, the brackets can vary the position of the brushes (124, 134) with respect to one another. More specifically, by positioning the brackets closer to the retention passageway, the brushes are closer to one another. When the brushers are closer to one another, more of the brushes overlap and engage one another so that the region that impinges and abuts against the bottom surface 160 of the head 152 of the stake 150 exhibits a higher stiffness level. It is apparent that as the degree of the overlap of the brushes increases the level of stiffness provided by the brushes engaging the stake will increase.

Figure 5A:
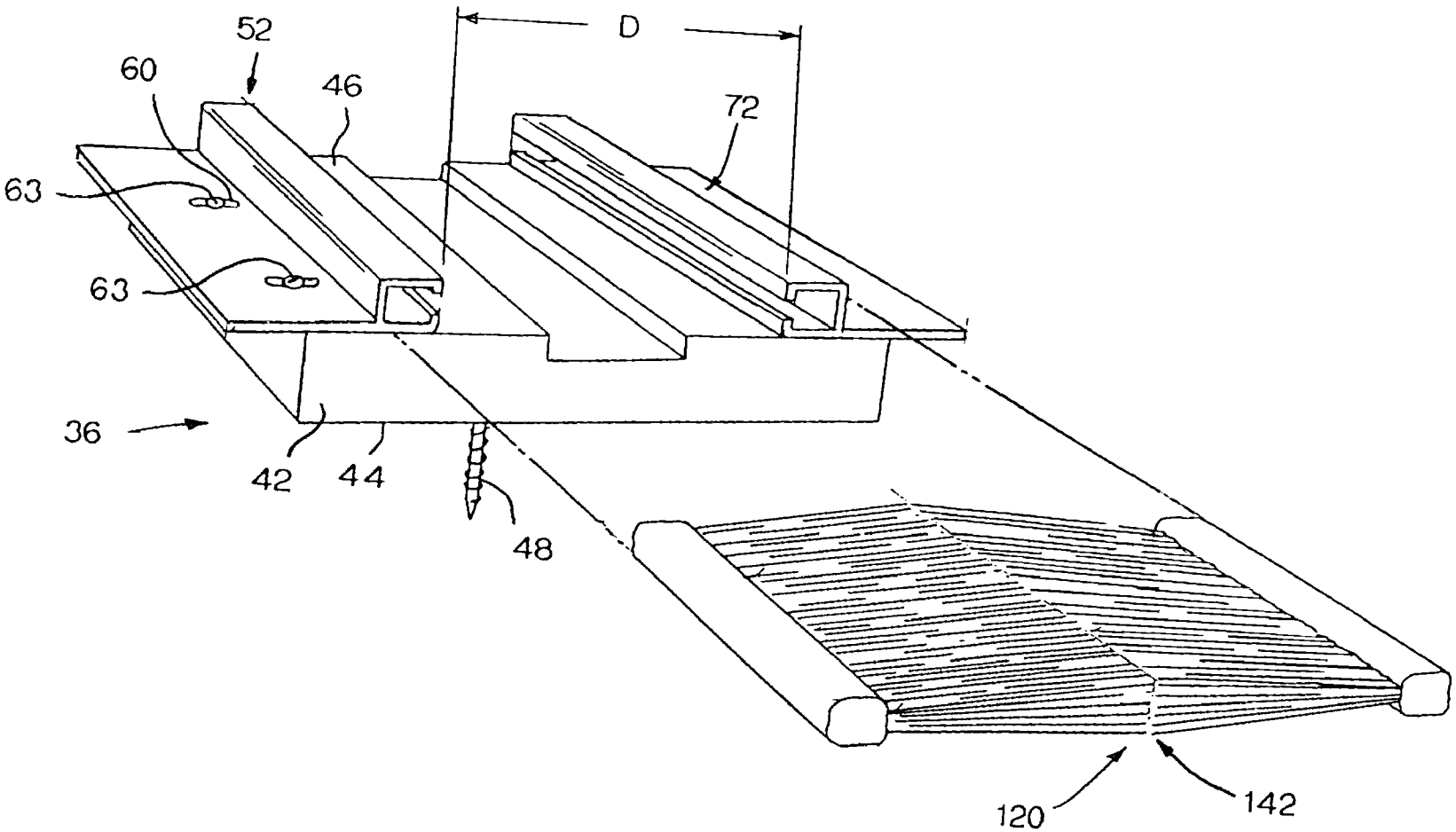
FIG. 5A is an isometric view of the stake retention assembly with the retention brush sets exploded away from the retention brackets and wherein the brackets are in another position relative to the retention passageway whereby the distal ends of the brushes just touch or abut one another.

FIG. 5 shows the brackets 52 at one position wherein the distal ends of the brushes overlap and engage one another. In the position shown in FIG. 5, the brackets are a distance "C" away from one another. To illustrate the adjustability feature, FIG. 5A shows the brackets 52 at another position wherein the distal ends of the brushes just touch or abut one another. In the position shown in FIG. 5A, the brackets are a distance "D" away from one another. It is apparent that the degree of stiffness provided by the brushes engaging the stake is higher for the arrangement shown in FIG. 5 than for the arrangement shown in FIG. 5A.

Figure 8A:
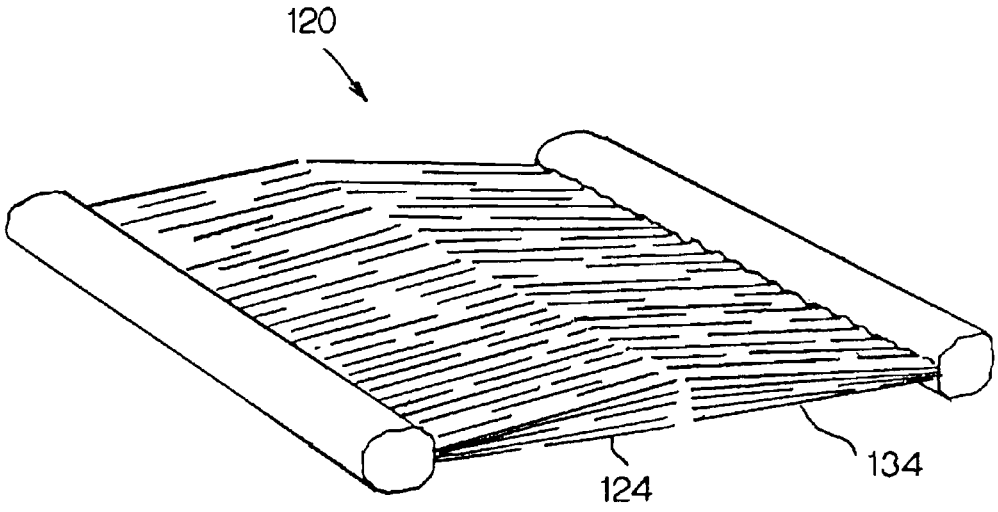
FIG. 8A is one embodiment of a retention brush set exhibiting a first level of stiffness.
Figure 8B:
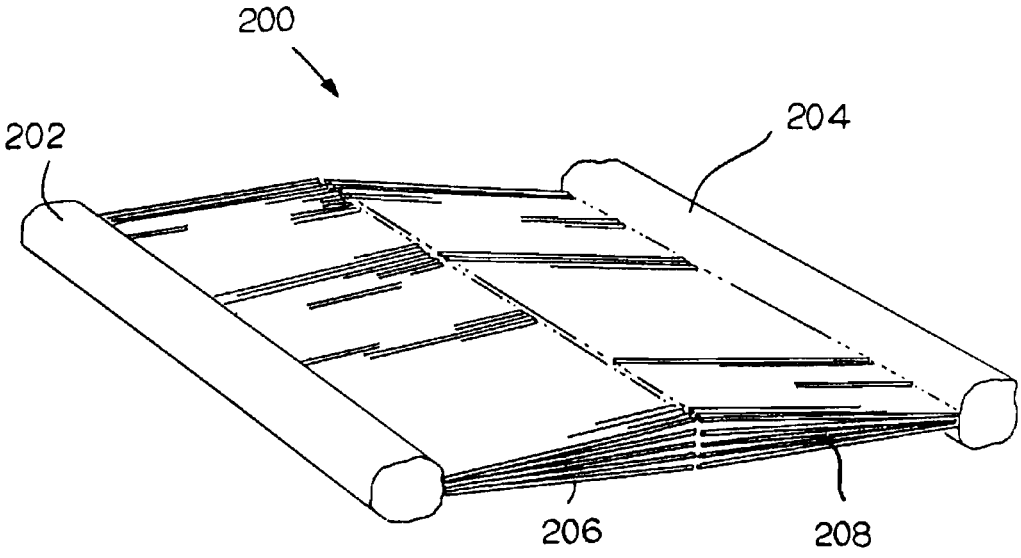
FIG. 8B is another embodiment of a retention brush set exhibiting a second level of stiffness wherein the second level of stiffness is greater than the first level of stiffness.

Referring to FIGS. 8A and 8B, the flexible holder or brush assembly can vary in that the stiffness of the brushes can be different between different brush assemblies. Thus, the different brush assemblies can accommodate stakes of different weights. For example, a brush assembly 120 with lighter brushes (124, 134), which do not exhibit a great stiffness level, can accommodate stakes that are lighter weight. A brush assembly 200 with heavier brushes (206, 208), which do exhibit a greater stiffness level, can accommodate stakes that are heavier. Brush assembly 120 comprises a pair of brushes 124, 134, which are relatively lighter, while the brush assembly 200 comprises a pair of brushes 206, 208, which are relatively heavier. Further, referring to FIG. 6B, the brush assembly 200 includes brush holders 202, 204 that connect to brushes 206, 208, respectively.

As shown in FIG. 5 in combination with FIGS. 6A and 6B, a brush assembly can be inserted into the corresponding bracket slot. It thus becomes apparent that the brush assemblies can be selectively connected to the stake retention assembly. The worker can thus make a selection from one set of brushes exhibiting a first level of stiffness and a second set of brushes exhibiting a second level of stiffness, and then install the desired set of brushes. Furthermore, as shown by the adjustability of the brackets, the worker can also vary the level of stiffness provided by the brushes engaging the stake by adjusting the position of the brackets.

What this means is that the worker has two ways to fine tune the stiffness provided by the brushes engaging the stake. The worker can either select brushes with a specific stiffness or vary the position of the brackets (and hence, the position of the brushes with respect to one another) to achieve a certain desired degree of stiffness provided by the brushes engaging the stake. The worker can also perform both in that the worker can select brushes with a specific stiffness and vary the position of the brackets to achieve a certain desired degree of stiffness provided by the brushes engaging the stake. The present invention provides a very advantageous feature by allowing the worker to make such fine tuned adjustments to achieve the desired degree of stiffness provided by the brushes engaging the stake. This feature also permits the present invention to accommodate a variety of stakes wherein some stakes may have a greater weight than others.

It becomes apparent that the present invention provides a stake installation tool that is an improvement over the use of a hammer to install stakes into the earth strata, and yet, is not a complex machine. The present invention provides a stake installation tool that does not require the worker to bend over repeatedly to install the stake into the earth strata. The present invention provides a stake installation tool that permits the worker to easily position the stake with reference to the tool prior to installation. The present invention provides a stake installation tool that is simple to use. The present invention provides a stake installation tool that can accommodate a variety of different kinds of stakes including metallic stakes (both magnetizable and non-magnetizable metallic stakes) and non-metallic stakes including without limitation plastic or biodegradable stakes. The present invention provides a stake installation tool that the worker can repair easily in the field.

The patents and other documents identified herein are hereby incorporated in their entirety by reference herein. Other embodiments of the invention will be apparent to those skilled in the art from a consideration of the specification or a practice of the invention disclosed herein. There is the intention that the specification and examples are illustrative only and are not intended to be limiting on the scope of the invention. The following claims indicate the true scope and spirit of the invention.

The invention claimed is:

1. A stake installation tool for installing a stake in strata wherein the stake has a head with a bottom surface at one end and a strata penetrator at the other end, the stake installation tool comprising:

a driver;

a stake retention assembly including a retention body, the retention body containing a retention passageway;

a flexible holder connected to the retention body; and the head of the stake being received within the retention passageway and the flexible holder engaging the head of the stake to operatively retain the stake; and wherein the retention passageway having a first side and a second side; the flexible holder comprises a first retention bracket adjacent to the first side of the retention passageway and a second retention bracket adjacent to the second side of the retention passageway; a first retention brush set being attached to the first retention bracket and extending over at least a portion of the retention passageway, and a second retention brush set being attached to the second retention bracket and extending over at least a portion of the retention passageway.

2. The stake installation tool according to claim 1 wherein the first retention brush set comprising a first plurality of brushes and the second retention brush set comprising a second plurality of brushes, and wherein the brushes in the first plurality of brushes and the second plurality of brushes exhibit a minimum stiffness level great enough to operatively retain the stake to the stake retention assembly.

3. The stake installation tool according to claim 2 wherein the first plurality of brushes operatively abuts the second plurality of brushes.

4. The stake installation tool according to claim 2 wherein the first plurality of brushes is adjustable relative to the second plurality of brushes so as to vary the degree of engagement between the first plurality of brushes and the second plurality of brushes.

5. The stake installation tool according to claim 4 wherein the first plurality of brushes and the second plurality of brushes being selected from the group consisting of at least one set of brushes exhibiting a first level of stiffness and a second set of brushes exhibiting a second level of stiffness, and the first level of stiffness not being equal to the second level of stiffness.

6. A stake installation tool for installing a stake in strata wherein the stake has a head with a bottom surface at one end and a strata penetrator at the other end, the stake installation tool comprising:

a driver;

a stake retention assembly including a retention body, the retention body containing a retention passageway;

a flexible holder connected to the retention body; and the head of the stake being received within the retention passageway and the flexible holder engaging the head of the stake to operatively retain the stake; and wherein the flexible holder comprises a plurality of brushes, and the brushes extending over the retention passageway, and when the head of the stake is received within the retention passageway, the brushes abut against the head of the stake to operatively retain the stake to the stake retention assembly.

7. The stake installation tool according to claim 6 wherein the brushes abut against the bottom surface of the head of the stake.

8. A stake installation tool for installing a stake in strata wherein the stake has a head with a bottom surface at one end and a strata penetrator at the other end, the stake installation tool comprising:

a driver;

a stake retention assembly including a retention body, the retention body containing a retention passageway;

a flexible holder connected to the retention body; and the head of the stake being received within the retention passageway and the flexible holder engaging the head of the stake to operatively retain the stake; and wherein the flexible holder comprises a plurality of brushes, and the brushes being selected from the group consisting of at least one set of brushes exhibiting a first level of stiffness and a second set of brushes exhibiting a second level of stiffness, and the first level of stiffness not being equal to the second level of stiffness.

9. The stake installation tool according to claim 1 wherein the driver having a distal end and a proximate end, and the driver being attached at the proximate end to the stake retention assembly.

10. The stake installation tool according to claim 9 wherein the driver having an axial length, and the driver being adjustable with respect to the axial length.

11. A stake installation tool for installing a stake in strata wherein the stake has a head at one end and a strata penetrator at the other end, the stake installation tool comprising:

a driver;

a stake retention assembly including a retention body, the retention body containing a retention passageway;

a flexible holder connected to the retention body, and wherein the flexible holder comprising a plurality of brushes;

the head of the stake being received within the retention passageway and the brushes engaging the head of the stake; and the brushes exhibiting an operative stiffness level between a minimum operative stiffness level stiff enough to operatively retain the stake within the retention passageway when the stake is within the retention passageway and a maximum operative stiffness level flexible enough to allow the stake installation tool to move away from the stake after installation of the stake in the strata without lifting the stake out of the strata.

12. The stake installation tool according to claim 11 wherein the stake has a weight, and the minimum operative stiffness level and the maximum operative stiffness level of the brushes corresponds to the weight of the stake.

* * * * *